US008816237B2

(12) United States Patent
Dufournet

(10) Patent No.: US 8,816,237 B2
(45) Date of Patent: Aug. 26, 2014

(54) INTERRUPTING CHAMBER FOR HIGH-VOLTAGE CIRCUIT BREAKER WITH IMPROVED ARC BLOW-OUT

(75) Inventor: Denis Dufournet, Sathonay Camp (FR)

(73) Assignee: Alstom Grid SAS, Paris (FR)

( * ) Notice: Subject to any disclaimer, the term of this patent is extended or adjusted under 35 U.S.C. 154(b) by 500 days.

(21) Appl. No.: 12/998,330

(22) PCT Filed: Jun. 17, 2009

(86) PCT No.: PCT/EP2009/057536

§ 371 (c)(1),
(2), (4) Date: Apr. 21, 2011

(87) PCT Pub. No.: WO2010/040574

PCT Pub. Date: Apr. 15, 2010

(65) Prior Publication Data

US 2011/0192821 A1 Aug. 11, 2011

(30) Foreign Application Priority Data

Oct. 9, 2008 (FR) ..... 08 56843

(51) Int. Cl.
*H01H 33/90* (2006.01)

(52) U.S. Cl.
CPC ..... *H01H 33/905* (2013.01); *H01H 2033/906* (2013.01); *H01H 2033/902* (2013.01); *H01H 2033/908* (2013.01)
USPC ..... 218/54; 218/46

(58) Field of Classification Search
USPC ..... 218/51–54, 61–64, 57, 59, 60, 66
See application file for complete search history.

(56) References Cited

U.S. PATENT DOCUMENTS

| | | | | |
|---|---|---|---|---|
| 4,486,632 | A | 12/1984 | Niemeyer et al. | |
| 4,577,074 | A | 3/1986 | Pham | |
| 4,650,941 | A | 3/1987 | Thuries et al. | |
| 4,774,388 | A | 9/1988 | Thuries et al. | |
| 5,723,840 | A * | 3/1998 | Bojic et al. | 218/60 |
| 6,462,295 | B1 * | 10/2002 | Knobloch et al. | 218/48 |
| 6,744,001 | B2 * | 6/2004 | Dufournet et al. | 218/66 |
| 2002/0117475 | A1 | 8/2002 | Dufournet et al. | |

FOREIGN PATENT DOCUMENTS

| | | |
|---|---|---|
| DE | 29 29 807 | 8/1980 |
| DE | 196 13 030 | 9/1997 |
| EP | 0 684 622 | 11/1995 |
| EP | 0 783 173 | 7/1997 |
| EP | 1 863 054 | 12/2007 |
| FR | 2 558 299 | 7/1985 |
| FR | 2 576 142 | 7/1986 |
| FR | 2 821 482 | 8/2002 |
| JP | 62-234825 | 10/1987 |

* cited by examiner

*Primary Examiner* — Amy Cohen Johnson
*Assistant Examiner* — Marina Fishman
(74) *Attorney, Agent, or Firm* — Baker Hostetler LLP

(57) ABSTRACT

The invention relates to an interrupting chamber for a high-voltage circuit breaker of preferably greater than at least 52 kV adapted to break all currents of value less than or equal to the short-circuit interrupting capacity of the circuit breaker, including asymmetric currents comprising an arc contact, an insulating arc blow-out nozzle having a through hole adapted to be blanked off by a valve, an insulating component which forms two channels, one of which is located between the insulating component and the arc contact, and wherein the hole is in communication with the channel.

12 Claims, 3 Drawing Sheets

INTERRUPTING CHAMBER FOR HIGH-VOLTAGE CIRCUIT BREAKER WITH IMPROVED ARC BLOW-OUT

TECHNICAL FIELD

The invention relates to interrupting chambers for high-voltage circuit breakers.

It relates to the improvement of the arc blow-out induced by all currents of value less than or equal to the short circuit interrupting capacity of the circuit breaker, including asymmetric currents.

It is more particularly connected with the optimisation of the exhaust route of the gases that contribute to the arc extinction.

The main application targets high voltage circuit breakers greater than 52 kV and more particularly circuit breakers of rated voltage greater than or equal to 245 kV.

PRIOR ART

FIGS. 1A to 1C represent in longitudinal sectional view a interrupting chamber 1 of a high-voltage circuit breaker according to the prior art of auto-pneumatic blow-out type, respectively:

- in the position of closing of the contacts,
- in an intermediate position at the start of the opening operation in which the moving arc contact 2 begins to separate from the fixed arc contact
- in the extreme position of opening in which the gas has been compressed and heated by the arc energy and the blow-out by the nozzle 4 has made it possible to cool the arc at the zero crossing and thereby obtain the cutoff of the short-circuit current.

When a current of high intensity, and in particular a current known as asymmetric, has to be interrupted by this type of auto-pneumatic blow-out circuit breaker, the pressure in the blow-out cylinder 5 is capable of reaching extremely high values because the rise in pressure is significantly increased by the conjunction of the compression of the gas (the compression volume 5 is reduced) and the heating of the gas by the arc produced.

In FIG. 2, are represented for a circuit breaker as represented in FIGS. 1A to 1C, the different curves of variation in pressure ΔP as a function of the opening time of the contacts T, each curve being representative of a type of short-circuit current to be cut by the circuit breaker. More precisely:

- curve C1 shows the increase in pressure that has taken place under no load in the circuit breaker, in other words without current present, said curve c1 representing the reference, value with a maximum ΔP equal to 1,
- curve C2 shows the increase in pressure that has taken place for a current of value equal to 30% of the interrupting capacity of the circuit breaker,
- curve C3 shows the increase in pressure that has taken place for a symmetric current of value equal to 100% of the interrupting capacity of the circuit breaker,
- curve C4 shows the increase in pressure that has taken place for an asymmetric current of value equal to 100% of the interrupting capacity of the circuit breaker.

It will thus be seen on reading these curves that:

- the maximum pressure is reached when an asymmetric current of value equal to 100% of the value of the interrupting capacity of the circuit breaker is reached (summit of curve C4),
- there is, in the example shown, a factor of around 4 between the maximum pressure reached by an asymmetric current of value equal to 100% of the value of the interrupting capacity of the circuit breaker is reached (summit of the curve C4) and the maximum pressure under no load (summit of curve C1),
- the type of current (symmetric or asymmetric) has a considerable impact on the increase in pressure ΔP: in this particular case, the maximum pressure of the asymmetric current (summit of curve C4) is around equal to 4/3 of the maximum pressure of the symmetric current (summit of curve C3).

Yet, if the pressure reached is excessive and becomes greater than the motive force delivered by the control to open the circuit breaker, the movement of the moving part of the interrupting chamber slows and can even reverse itself. The interrupting capacity of the circuit breaker is then reduced because the blow-out is then reduced due to the slowing down of the movement of the moving part.

A problem to resolve is to have a sufficiently high overpressure to obtain the breaking (cutoff) with intermediate currents at 30%, 60%, 75% and 90% of the interrupting capacity of the circuit breaker, without having an excessive overpressure with 100% of the interrupting capacity.

Thus, to maintain the interrupting capacity at a high value whatever the intensity of the current, it is necessary to limit the overpressure to an acceptable value when the circuit breaker cuts a current equal to 100% of its interrupting capacity, compatible with the force delivered by the control, and to ensure that all of the gas contained in the blow-out volume is effectively used for blow-out the arc, in ordered to have an optimised solution, without loss of gas.

Different solutions for the outflow from the arc blow-out volume have been envisaged previously.

The patent FR 2 694 987 proposes a solution that has the aim of limiting the overpressure for long arc times. The limitation of overpressure is made by increasing the blow-out volume (V1+V2+VC) from a given stroke of the apparatus. The solution proposed according to this document has the main drawback of reducing the overpressure for all the breakings carried out with long arc times, including those carried out with currents of low intensity with which a reduction of overpressure is not desired.

The patent EP 1 863 054 proposes a solution with a check valve 16, 17 fitted on the blow-out piston 10, which makes it possible to limit the overpressure to a given value. When the check valve 16, 17 opens, this solution has the drawback of causing a loss of blow-out gas to the exterior of the blow-out volume without being used for the blow-out of the arc. This solution is thus not optimised.

The patent EP 0 783 173 proposes a solution of limitation of overpressure in a thermal expansion volume and not in the compression volume situated to the rear of the check valve 26. But, the overpressure in the expansion volume is without effect on the displacement of the contacts and thus the energy that needs to be supplied by the control.

The patent DE 19 613 030 discloses a interrupting chamber with auto blow-out (with a check valve 20 between the thermal expansion volume 10 and the compression volume 9). There is not in this case any check valve limiting overpressure on the piston 8. In the case of a cutoff of strong current, the high overpressure in the volume 10 brings about the closing of the check valve 20. The overpressure in the volume 9 is limited by a permanent exhaust through the channel 23, 13, 14. The major drawback of this solution resides in the fact that when the pin 1 has ceased to obstruct the channel 14, the compression volume empties itself permanently, including for currents of value ranging between 10 and 30% of the interrupting capacity of the circuit breaker, in an area 14 situated downstream of the main blow-out channel 12, far from the root of the arc 4. Consequently, the blow-out carried out is not very efficient.

The patent FR 2 558 299 discloses a blow-out exerted in a zone referenced 10A in FIG. 1 and which comes from a thermal expansion volume 9 where the rise in pressure is achieved uniquely by heating and without possible mixing with the compressed gas. Another drawback is that the auto-pneumatic blow-out is exerted far from the root of the arc which takes place at the point referenced 8A in FIG. 1 and there is no aid to the rise in pressure in the volume 13 by thermal effect, the volumes 9 and 13 not communicating together (volumes not in hydraulic series). This type of solution has not been applied industrially due to its reduced cutoff capacities.

The patent FR 2 576 142 proposes a solution where there is no overpressure limiting device in the volume 27. A forward force is supposed to increase the energy of operation by increasing the pressure in the volume 32 by transmission of hot gases coming from the channel 20. In practice, the force supplied is negligible, given the length of the channel 20 to 22 in the embodiment of FIGS. 1 to 3 and the fact that the volume 32 increases with the displacement of the contacts. So, the solution has not been applied.

The patent FR 2 821 482 discloses an auto blow-out interrupting chamber with a check valve between the thermal expansion volume 4 and the compression volume 5. The check valve proposed is not a device limiting overpressure on the piston 9. When the overpressure is very high in the volume 4 (breaking of strong currents), the moving part of the check valve 15 opens and the volume 5 empties itself through the channel 13 and downstream of the nozzle neck 3A. The emptying thus takes place far from the root of the arc taking place at the end of the moving arc contact 2, and thus is not efficient for the breaking of the current. The emptying envisaged in this document can thus only serve for the evacuation of the hot gases in the divergent of the nozzle downstream of the neck 3A.

The U.S. Pat. No. 4,486,632 proposes a solution where there is no limitation of overpressure in the compression volume 8. The heating of the gas in the thermal expansion volumes 6, 7 is supposed to give a forward force to aid the operation by pushing on the part 15, but this effect is limited because the volume 7 increases during the operation, which tends to reduce the motive overpressure. The reduction in the operating stresses is thus limited. Furthermore, the thermal expansion 6, 7 and compression 8 volumes do not communicate with each other and are thus in parallel and not in series, as in the patent FR 2 558 299.

The aim of the invention is thus to propose a solution that offsets the drawbacks of the prior art and which proposes a interrupting chamber in which the arc blow-out is efficient for symmetric or asymmetric currents, whatever their relative value compared to the interrupting capacity of the current, and the energy of operation of the moving part of which remains limited.

DESCRIPTION OF THE INVENTION

To this end, the invention relates to a interrupting chamber for a high-voltage circuit breaker, intended to break all currents of value less than or equal to the short circuit interrupting capacity of the circuit breaker, including asymmetric currents, the chamber comprising two pairs of contacts each comprising an arc contact and adapted to separate apart during an arc breaking, an insulating arc blow-out nozzle comprising a neck, the arc blow-out nozzle being integral with a pair of contacts constituting a moveable assembly, the interrupting chamber comprising an additional insulating component integral with the arc contact, itself integral with the nozzle and arranged between the part of the nozzle upstream of the neck and the arc contact so as to define two channels, the channel defined between the nozzle and the additional insulating component opening out permanently towards a cavity of variable volume, the volume of the cavity being variable under the action of a fixed blow-out piston, the blow-out piston being pierced with a through hole adapted to be blanked off by a valve.

According to the invention, the loading of the valve makes it possible to blank off the hole when the overpressure exerted in the cavity is less than a predetermined value, the hole being a through hole in the channel defined between the insulating component and the arc contact, when the overpressure exerted in the cavity is greater than the predetermined value, the valve loading being carried out so as to conserve a sufficiently high overpressure in the cavity for the whole range of currents to be broken.

Thus, according to the invention, a shut-off valve is installed on the blow-out piston in such a way that the gas evacuated by the shut-off valve serves fully in the arc blow-out.

To do this, a communication is established between a volume situated downstream of the shut-off valve and a portion of the arc between the moving arc contact and a component made of insulating material that thus defines this portion of arc and channels the gas of this additional blow-out. The additional blow-out according to the invention is efficient because it is carried out near to the root of the arc initiated on the arc moving contact.

In other words, a compromise is made between the operating energy to be deployed for all the values of short-circuit current be it symmetric or asymmetric and the effectiveness of the arc blow-out that occurs on breaking: by blowing out the arc at the root through a part of the thermal expansion volume (when the interrupting chamber is of auto-pneumatic blow-out type) or through the compression volume (when the interrupting chamber is of auto-blow-out type) for arcs with a current whose value is greater than around the given percentage of the breaking value of the circuit breaker.

A interrupting chamber according to the invention may thus be of auto-pneumatic blow-out type or auto blow-out type.

As is well known by those skilled in the art, specialists of high or medium voltage circuit breakers, an interrupting chamber of auto-pneumatic blow-out type is characterised by the fact that during the opening operation, the circuit breaker itself produces the compression of the gas necessary for the blow-out of the arc. The relative displacement of the blow-out cylinder in relation to the fixed piston creates an overpressure in the cylinder which evacuates to the interior of the nozzle and cools the arc, thereby enabling its extinction.

Circuit breakers (interrupting chambers) of auto blow-out type are characterised by the important use of the arc energy for the breaking: the blow-out by auto blow-out is substituted to a large extend by the auto-pneumatic blow-out for the breaking of strong currents. The breaking of weak currents is still obtained by auto-pneumatic blow-out, the energy of the arc not being sufficient to contribute to the blow-out.

Thus, when the interrupting chamber is of auto-pneumatic blow-out type, the opening of the valve according to the invention is caused directly when the overpressure in the blow-out volume due both to the compression and to the heating of the gas is greater than a determined value. In fact, in this embodiment, the cavity of variable volume (blow-out volume) also constitutes a thermal expansion volume because the arc produced adds its energy directly to the cavity and thus, the blow-out piston is directly in physical contact with this thermal overpressure.

Preferably, when the interrupting chamber is of auto-pneumatic blow-out type, the loading of the valve is such that its opening, placing in communication the hole with the channel defined between the insulating component and the arc contact, takes place for currents for which the value is greater than or equal to 90% of the interrupting capacity.

Preferably, when the interrupting chamber is of auto-blow-out type, the loading of the valve is such that its opening placing in communication the hole with the channel defined between the insulating component and the arc contact takes place for currents for which the value is greater than or equal to 30% of the interrupting capacity.

An interrupting chamber according to the invention of auto blow-out type, comprises advantageously:

- a fixed wall arranged between the channel defined between the nozzle and the additional insulating component and the blow-out piston, the fixed wall thereby defining a thermal expansion volume, and the cavity of variable volume being thereby defined between the piston and the fixed thermal expansion wall;
- an additional ball type valve fitted on the fixed wall and enabling the passage of gas from the cavity of variable volume into the thermal expansion volume.

To avoid the escape of the hot gases produced into an area near to the moving arc contact assembly, during the breaking of strong currents, a non return check valve fitted in the channel defined between the insulating component and the arc contact may advantageously be provided.

When the interrupting chamber is of auto blow-out type, the opening of the valve is caused indirectly as it were due to the heating of the gas contained in the thermal expansion volume. In fact, in this embodiment, a fixed thermal expansion volume is provided in which opens out the channel between the nozzle and the additional insulating component, said fixed thermal expansion volume being separated from the cavity of variable volume by a fixed wall in which is fitted an additional valve but with an assembly opposite to that of the valve adapted to blank off the through hole in the blow-out piston. Thus, when the energy of the arc is low, the thermal heating is insufficient to cause the closing of the additional valve on the fixed wall. The piston, the through hole of which is blanked off, compresses the volume of gas from the cavity which passes into the thermal expansion volume. The blow-out of the arc is thus realised by the volumes of compressed gas present on either side of the fixed wall via the channel between the nozzle and the additional insulating component. When the energy of the arc is high, the thermal heating in the thermal expansion volume causes the closing of the additional valve on the fixed wall. The blow-out is then realised in combination and in two separate areas:

- the overpressure created in the thermal expansion volume realises a blow-out via the channel between the nozzle and the additional insulating component,
- the compression created in the cavity by the piston realises an additional blow-out at the root of the arc on the fixed arc contact via the through hole of the piston and the channel between the additional insulating component and said fixed arc contact.

As seen above, in the case of an auto-pneumatic circuit breaker, the additional blow-out via the through hole of the piston is obtained advantageously with a percentage of default current (expressed in relation to the short circuit interrupting capacity) which is advantageously 90% with a symmetric current, but depending on the application considered a lower percentage may prove to be interesting. It is estimated in fact that from such a value of 90% of arc currents compared to the interrupting capacity, that it proves to be essential for most high voltage circuit breakers greater than 52 kV, to reduce the energy of operation. There is, according to the invention, a preference for limiting the overpressure slightly for currents slightly above 90% because, according to tests standardised by the CEI, a very restrictive cutoff condition is provided with a symmetric current of value equal to 90% of the interrupting capacity. The sequence of tests is called the L90 on-line fault in the CEI 62271-100 standard for high voltage circuit breakers. It is thus necessary to limit the overpressure below this current value.

As also seen above, in the case of circuit breakers with auto blow-out, the opening of the valve and the additional blow-out take place at currents greater than 30% of the interrupting capacity.

Obviously, those skilled in the art will be able to determine the percentage compared to the value of the interrupting capacity as a function of tests standardised by the CEI which are applicable to the high-voltage circuit breaker considered.

According to an advantageous construction embodiment, the valve is constituted of a relief valve fitted in the piston.

The blow-out piston comprises according to a preferred construction embodiment two parallel dividing walls, spaced apart, connected together by a tubular portion and between which is fitted the relief valve, the seat of which is constituted of a through hole pierced in the downstream dividing wall and one end of which is fixed to one end of a compression spring, the other end of which is resting against the upstream dividing wall, the communication with the channel defined between the insulating component and the arc contact being formed by another through hole pierced in the tubular portion of the piston and a port formed in a portion integral with the arc contact and in continuity with the additional insulating component.

Preferably, the upstream and downstream dividing walls each comprise a valve, the opening of which enables the flow of gases upstream of the upstream dividing wall towards the downstream of the downstream dividing wall and thus, the coming together of the pairs of contacts during a closing operation of the circuit breaker.

It is possible to provide drive means in the interrupting chamber which enable the two pairs of contacts to be made moveable, the invention is thus applicable to chambers known as double motion chambers.

The invention also relates to a high-voltage circuit breaker greater than 52 kV and more particularly greater than 170 kV, up to 420 kV, comprising an interrupting chamber as defined previously.

BRIEF DESCRIPTION OF DRAWINGS

Other advantages and characteristics will become clear on reading the detailed description of an example made with reference to the following figures in which.

DETAILED DESCRIPTION OF SPECIFIC EMBODIMENTS

Figure 1A:
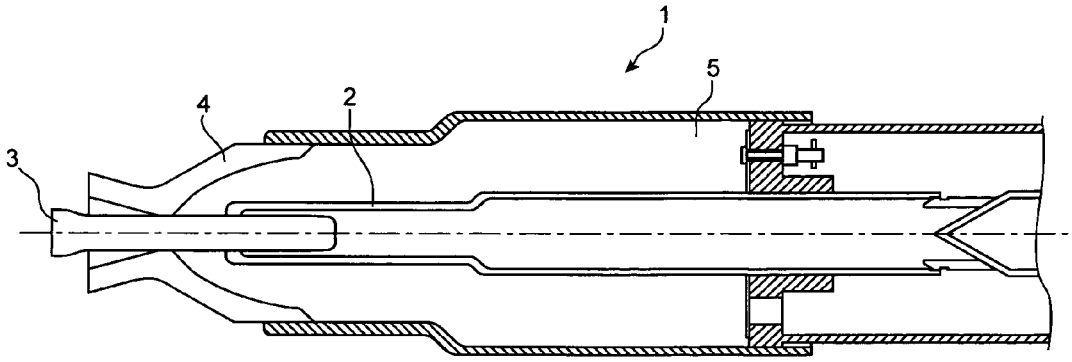
FIGS. 1A to 1C schematically show in longitudinal and partial sectional view an auto-pneumatic blow-out chamber according to the prior art in different positions of the contacts.
Figure 1B:
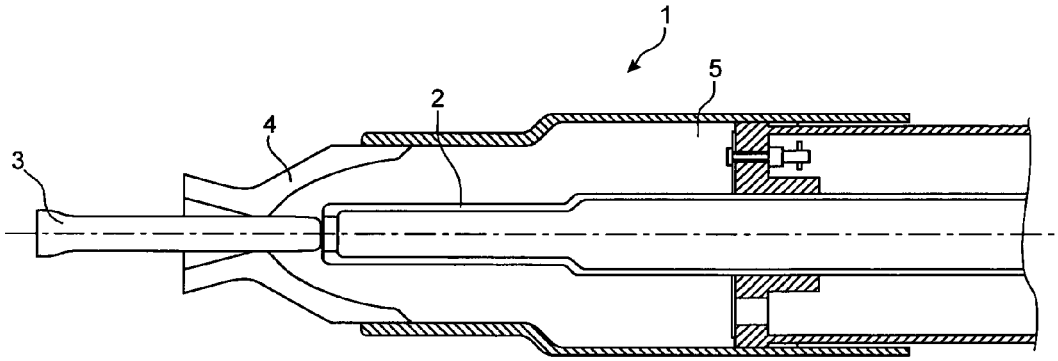
Figure 1C:
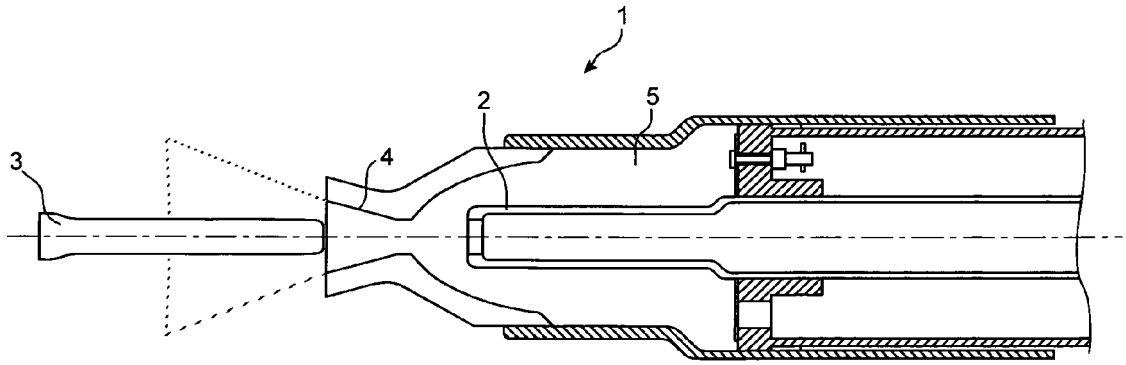
Figure 2:
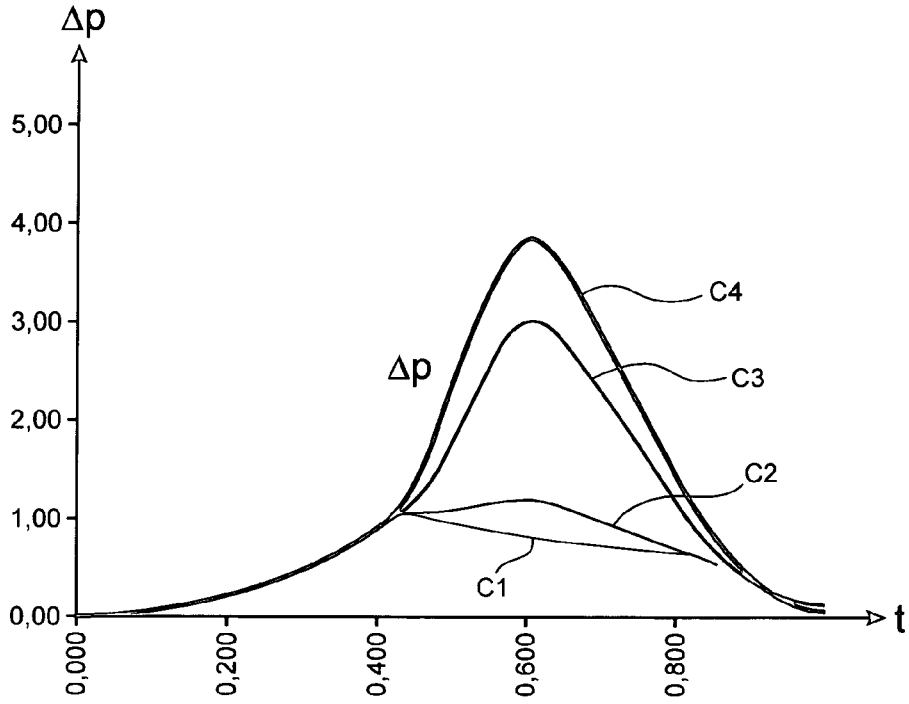
FIG. 2 shows different curves of variation in pressure $\Delta P$ as a function of the opening time of the contacts T, each curve being representative of a type of short-circuit current to be cut by the circuit breaker according to FIGS. 1A to 1C, FIGS. 3A and 3B schematically show in longitudinal and partial sectional view an auto-pneumatic blow-out interrupting chamber of a circuit breaker according to the invention in a position of end of opening for an arc cutoff of value respectively less than around 90% and greater than around 90% of the interrupting capacity, FIG. 4 schematically shows in longitudinal and partial sectional view an auto-blow-out interrupting chamber of a circuit breaker according to the invention in a position of opening for an arc cutoff of value less than 90% of the interrupting capacity.

FIGS. 1 and 2 have already been explained above.

For reasons of clarity, the same parts and portions of parts are designated by the same numerical references, both for the interrupting chamber according to the prior art and for that according to the invention.

In all of the figures, the two main contacts of each interrupting chamber, one of which is integral with the blow-out nozzle, are not represented.

Figure 3A:
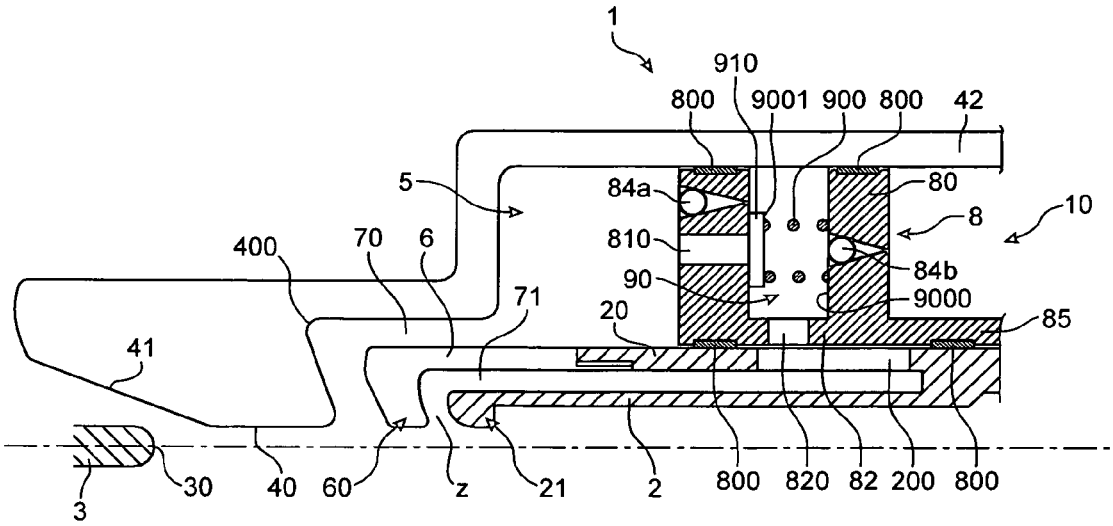
Figure 3B:
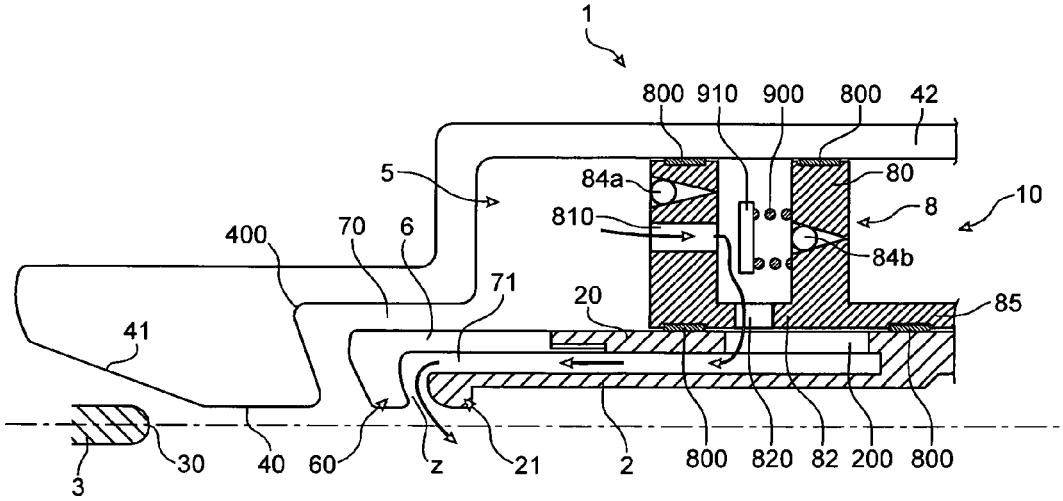
Figure 4:
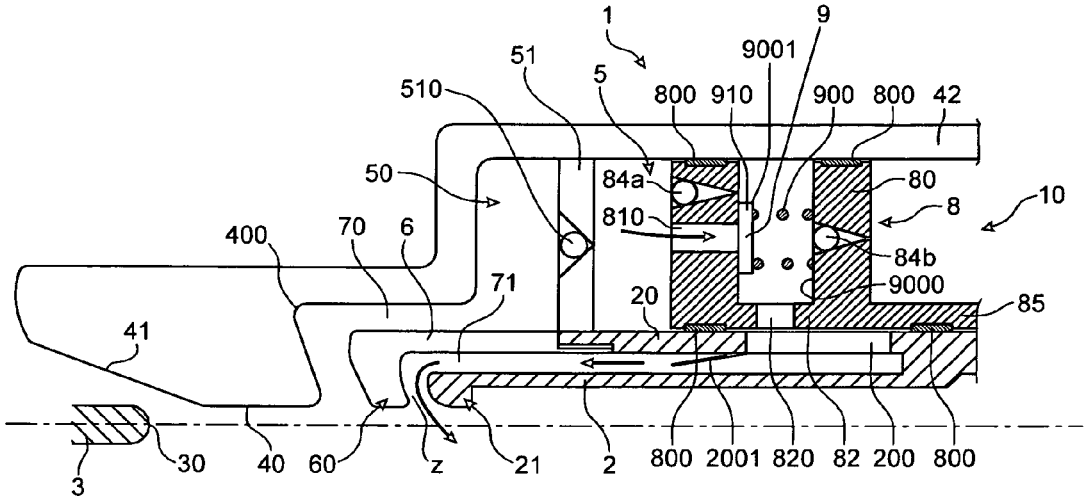

It is also pointed out that the terms "downstream" and "upstream" used respectively designate the left and the right in FIGS. 3A, 3B and 4.

The interrupting chamber according to the invention 1 comprises a moving arc contact 2 constituted of a metal tube and a fixed arc contact pin 3 also metal of complementary shapes.

The moving arc contact 2 is integral with a blow-out nozzle 4 and an additional insulating component forming a cowl 6. More precisely, the cowl 6 is fixed in continuity downstream of a tubular part 20 integral with the moving contact 2.

The end of the insulating cowl 60 has an external profile complementary to the interior 400 of the nozzle 4 and an internal profile complementary to that of the end 21 of the moving contact.

The nozzle 4 comprises downstream of its interior 400, a neck 40 and a divergent 41 in continuity downstream of the neck 40. The nozzle 4 comprises in its upstream part a tubular part 42 defining with the upstream part of the cowl 6 and the tubular portion 20 with which it is fixed a cylindrical annular cavity 5.

The schematised tubular part 42 forms part of the main contact not represented.

The layout of the insulating cowl 6 in relation to the nozzle 4 and to the functional part 21 of the fixed contact and its tubular part 20 to which is fixed said insulating cowl 6 defines two channels 70, 71. One of the channels 70 is in direct communication with the cylindrical annular cavity 5. The other channel 71 opens out downstream in an area Z defined respectively by the end 60 of the insulating cowl 6 and the end 21 of the moving contact 2 and upstream in a port 200 made in the tubular part 20 of the moving contact 2.

The cylindrical annular cavity 5 has a volume that is variable under the action of a blow-out piston 8 of the gases.

This piston 8 is fitted without clearance between the tubular part 42 of the nozzle 4 and the tubular part 20 of the moving contact 2. More precisely, on its external periphery are fixed pressure seals 800 which are moreover adapted to helping the moving assembly 2, 4, 6 slide on the piston 8.

This piston 8 essentially comprises two dividing walls 80, 81 parallel with each other and connected together by means of a tubular connecting dividing wall 82 which is adjacent and parallel to the tubular part 20 of the fixed contact 2. The downstream dividing wall 81 comprises a through hole 810. The connecting dividing wall 82 also comprises a through hole 820.

The three dividing walls 80, 81, 82 are integral with a main tubular part 83, which has the function of fixing at a precise distance the piston 8 in relation to the translational stroke of movement made by the moving assembly constituted of the nozzle 4, the insulating cowl 6 and the fixed contact 2. More specifically, the fixing of the piston 8 and the translation stroke of the moving assembly 2, 4, 6 are determined in order that over the whole end of the opening operation the through hole 820 made in the intermediate connecting dividing wall 82 is facing the port 200 made in the tubular part 20 of the fixed contact 2. In the embodiment illustrated, the end of operation corresponds to the passage of the end 30 of the fixed arc contact pin 3 from a position in which it is in the neck 40 of the nozzle 4 to a position in which it has left the neck 40 of the nozzle 4 and reached the downstream part (in the direction of the flow of the gas) from the divergent 41 of the nozzle, as represented in FIGS. 3A and 3B. In this latter position, it may be seen that the through hole 820 is facing the extreme downstream portion of the port 200.

Inside the piston is assembled a plate-spring system which constitutes the moving part 90 of a check valve 9. More specifically, a compression spring 900 has one end 9000 fixed on the internal wall of the upstream dividing wall 80 and the other end 9001 fixed to a plate 910 of transversal dimensions greater than the width of the through hole 810 made in the downstream dividing wall 81. As a function of the overpressure of gas reigning in the cavity 5 and the loading carried out on the spring, the plate 910 obstructs or not the through hole 810 which constitutes the seat part of the check valve 9. The loading of the spring according to the invention is carried out in such a way that the opening of the hole 810 and thus the passage of the gases in the space between the two dividing walls 80, 81 of the piston takes place when the level of overpressure is reached by a current of a value greater than or equal to around 90% of the interrupting capacity of the circuit breaker.

A ball type valve 84*a*, 84*b* is fitted in each of the dividing walls upstream 81 and downstream 80 of the piston 8. As explained below, these valves 84*a*, 84*b* remain shut during the whole opening operation of the circuit breaker and only serve for the closing to enable the passage of insulating gas from the upstream cavity 10 to the blow-out cavity 5.

The embodiment illustrated in FIG. 4 corresponds to an interrupting chamber of auto blow-out type according to the invention: the chamber illustrated copies in an identical manner the same components illustrated in FIG. 3 and detailed above and comprises in addition the following components.

A wall 51 is fixed between the tubular part 42 of the nozzle 4 and the tubular part 20 of the moving contact 2. This fixed wall 51 is downstream of the blow-out piston 8.

Thus, the cylindrical annular cavity of variable volume 5 under the action of the piston 8 is defined on one hand by the latter and on the other hand by the fixed wall 51.

Downstream of the fixed wall 51 is thus defined a thermal expansion volume 50.

On the fixed wall 51 is fitted an additional ball type valve 510 enabling the passage of gas from the cavity of variable volume 5 into the thermal expansion volume 50.

Finally, a non return (or in other words one-way) check valve 2001 is fitted in the channel 71 immediately downstream of the port 200.

The operation of the interrupting chamber 1 of the high-voltage circuit breaker according to the embodiment of FIGS. 3A and 3B will now be explained.

When the overpressure of the gases is generated by an arc between contacts 2, 3 of a value substantially less than 90% of the interrupting capacity of the circuit breaker, the check valve 9 cannot open (FIG. 3A). The blow-out of the gases is carried out as in the prior art represented in FIG. 1, in other words with an auto-pneumatic blow-out uniquely by the channel 70 from the cavity 5.

When the overpressure is generated by an arc between contacts 2, 3 of a value greater than 90% of the interrupting capacity of the circuit breaker, the check valve 9 opens, which causes the escape of part of the compressed gases through the hole 820, the port 200 then the channel 71 as shown by the arrows in FIG. 3B.

The additional blow-out thereby realised by the gases flowing through the channel 71 takes place in the area Z, in other words as near as possible to the arc root.

In this way is obtained, on the one hand, a limitation of the overpressure that has taken place in the blow-out volume constituted of the cavity 5 since the check valve 9 re-closes when the pressure becomes less than the value of the loading of the spring 900 and, on the other hand, an additional efficient blow-out as near as possible to the arc root Z.

Whatever the value and the type (symmetric or asymmetric) of the current to be broken, the loading of the spring and the relative dimensions of the through hole 810 compared to the blow-out cavity 5 make it possible to conserve a sufficient overpressure in said cavity 5.

During the closing of the circuit breaker, the sliding of the moveable assembly 2, 4, 6 towards its closing position (from right to left in FIGS. 3A and 3B) generates a low pressure in the volume of the cavity 5 which is compensated by the passage of insulating gas from the cavity 10 upstream of the piston 8 through the valves 84*a*, 84*b*, the check valve 9 remaining for its part shut.

The solution according to the invention has an important advantage for circuit breakers with auto-pneumatic chamber, in particular for those of the type with strong interrupting capacity e.g. 63 kA. In fact, the cutoff overpressures of asymmetric currents in this type of circuit breakers are such that a solution has to be found in order to use a hydraulic jack of acceptable energy/price.

The operation of the interrupting chamber 1 of the high-voltage circuit breaker according to the embodiment of FIG. 4 will now be explained.

When the overpressure of the gases is generated by an arc between contacts 2, 3 of a value substantially less than around 30% of the interrupting capacity of the circuit breaker, the check valve 9 cannot open and the additional valve 510 opens under the effect of the gas compressed in the cavity 5 by the piston. The blow-out of the gases is realised as in the prior art represented in FIG. 1, in other words with an auto-pneumatic blow-out uniquely by the channel 70 from the cavity 5 via the volume 50. In other words, the thermal heating in the volume 50 is insufficient to cause the closing of the additional valve 510 on the fixed wall 51. The piston 8, the through hole 810 of which is blanked off, compresses the volume of gas from the cavity 5 which passes into the volume 50. The blow-out of the arc is thus realised by the volumes of compressed gas present on either side of the fixed wall via the channel between the nozzle and the insulating cowl 6.

When the overpressure is generated by an arc between contacts 2, 3 of a value greater than 30% of the interrupting capacity of the circuit breaker, the thermal heating in the thermal expansion volume 50 causes the closing of the additional valve 510 on the fixed wall 51, whereas the check valve 9 opens when the overpressure created by compression in the cavity 5 is sufficient to overcome the force of the spring 900.

The blow-out is then realised in two separate areas:

- the overpressure created in the thermal expansion volume 50 realises a blow-out via the channel 70 between the nozzle 4 and the insulating cowl 6,
- the compression created in the cavity 5 by the piston 8 realises an additional blow-out at the root of the arc on the fixed arc contact 2 via the open through hole 810 of the piston, the through hole 820, the port 200 and the channel 71 between the insulating cowl 6 and said fixed arc contact 2.

Moreover, the inventors have identified a potential risk during a breaking of strong currents: hot gas can escape into the channel 71 and into the port 200, raising the pressure in the volume 900 and closing the check valve 910. As seen previously, there is an overpressure through thermal expansion of the hot gases in the fixed volume 50, causing the closing of the valve 510. There is then a risk during the opening operation of compression of the volume in the cavity 5 without possible evacuation of the gas and thus considerable slowing down of the movement, which can lead to the failure of the cutoff.

To avoid this major drawback, the one-way check valve fitted in the channel 71 avoids the escape of the hot gases into the volume 900 and enables normal operation: the emptying takes place from the compression volume of the cavity 5 into the volume 900 and the blow-out of the arc is possible through the port 200 and the channel 71 when the current is in the vicinity of its zero crossing (time interval beginning a little before the zero crossing and then lasting throughout the voltage restoration phase).

The additional blow-out thereby realised by all of the compressed gas flowing through the channel 71 occurs for sure in the area Z, in other words as near as possible to the root of the arc.

Whatever the value and the type (symmetric or asymmetric) of current to be cut, the loading of the spring and the relative dimensions of the through hole 810 in relation to the blow-out cavity 5 make it possible to conserve a sufficient overpressure in said cavity 5.

The closing operation takes place in an identical manner to that described with reference to FIGS. 3A and 3B.

The solution according to the invention is thus viable because it may be applied to any auto-blow-out interrupting chamber, with the advantage of not producing voluntary loss of compressed gas.

The invention claimed is:

1. An interrupting chamber for high-voltage circuit breaker, intended to break all currents of value less than or equal to the short circuit interrupting capacity of the circuit breaker, including asymmetric currents, the chamber comprising a pair of contacts, the pair of contacts comprising an arc contact and adapted to be separated apart during an arc breaking, an insulating arc blow-out nozzle comprising a neck, the arc blow-out nozzle being integral with the arc contact thereby constituting a moveable assembly, the interrupting chamber comprising an additional insulating component integral with the arc contact and the nozzle and arranged between an interior part of the nozzle upstream of the neck and the arc contact so as to define a first channel and a second channel, the first channel being defined between the nozzle and the additional insulating component and with the interrupting chamber having a cavity of variable volume, the volume of the cavity being variable under the action of a fixed blow-out piston, the blow-out piston being pierced with a through hole adapted to be closed by a main valve, with the main valve being closed when the overpressure exerted in the cavity is less than a predetermined value, the hole being in communication with the second channel defined between the additional insulating component and the arc contact, when the overpressure exerted in the cavity is greater than the predetermined value, the main valve loading being carried out so as to conserve a sufficiently high overpressure in the cavity for the entire range of currents to be broken.

2. The interrupting chamber according to claim 1, in which the opening of the main valve opens communication with the second channel defined between the additional insulating component and the arc contact, the opening of the main valve takes place for currents having a value greater than or equal to 90% of the interrupting capacity.

3. The interrupting chamber according to claim 1, in which the opening of the main valve opens communication with the second channel defined between the additional insulating component and the arc contact, the opening of the main valve takes place for currents having a value greater than or equal to 30% of the interrupting capacity.

4. The interrupting chamber according to claim 3, comprising:

a fixed wall arranged between the first channel defined between the nozzle and the additional insulating component and the blow-out piston, the fixed wall thereby defining a thermal expansion volume, and the cavity of variable volume thereby being defined between the piston and the fixed wall;

an additional ball valve fitted on the fixed wall and enabling the passage of gas from the cavity of variable volume into the thermal expansion volume.

5. The interrupting chamber according to claim 4, further comprising a non-return check valve fitted in the second channel defined between the additional insulating component and the arc contact to avoid the escape of hot gases produced in an area near to the arc contact of the moveable assembly to the blow out piston during the breaking of strong currents.

6. The interrupting chamber according to claim 1, in which the main valve is a relief valve fitted in the piston.

7. The interrupting chamber according to claim 1, in which the blow-out piston comprises two parallel dividing walls connected together by a tubular portion, the main valve is fitted between the dividing walls, a seat of the main valve is the edge of a through hole provided in the downstream dividing wall, one end of the main valve is fixed to one end of a compression spring, the other end of said compression spring is resting against the upstream dividing wall; a space between the two dividing walls being in communication with the second channel defined between the additional insulating component and the arc contact being formed by another through hole provided in the tubular portion of the piston and a port formed in a portion integral with the arc contact and in continuity with the additional insulating component.

8. The interrupting chamber according to claim 7, in which the upstream and downstream dividing walls each comprise an additional valve, the opening of which enables the flow of the gases upstream of the upstream dividing wall to downstream of the downstream dividing wall and thus, the coming together of the pairs of contacts during a closing operation of the circuit breaker.

9. The interrupting chamber according to claim 1, in which the pair of contacts are moveable.

10. A high-voltage circuit breaker greater than 52 kV, comprising an interrupting chamber according to claim 1.

11. The interrupting chamber according to claim 1, in which the opening of the main valve opens communication with the second channel defined between the additional insulating component and the arc contact, the opening of the main valve takes place for currents which are greater than or equal to 90% of the short circuit interrupting capacity of the circuit breaker, whereby the interrupting chamber is of the auto-pneumatic blow-out type.

12. The interrupting chamber according to claim 1, in which the opening of the main valve opens communication with the second channel defined between the additional insulating component and the arc contact, the opening of the main valve takes place for currents which are greater than or equal to 30% of the short circuit interrupting capacity of the circuit breaker, whereby the interrupting chamber is of the auto-blow-out type.

* * * * *